US008070321B2

(12) United States Patent
Blincoe

(10) Patent No.: US 8,070,321 B2
(45) **Date of Patent: *Dec. 6, 2011**

(54) LIGHTING UNIT DESIGNED TO MAINTAIN A T3 TEMPERATURE INSIDE ITS HOUSING

(75) Inventor: Patrick Stephen Blincoe, Kirkville, NY (US)

(73) Assignee: Cooper Technologies Company, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/641,619

(22) Filed: Dec. 18, 2009

(65) Prior Publication Data

US 2010/0254150 A1 Oct. 7, 2010

Related U.S. Application Data

(63) Continuation of application No. 11/940,670, filed on Nov. 15, 2007, now Pat. No. 7,654,694, which is a continuation of application No. 10/891,448, filed on Jul. 15, 2004, now Pat. No. 7,300,181.

(51) Int. Cl.
*F21V 31/00* (2006.01)

(52) U.S. Cl. ..... 362/267; 362/294; 362/147; 362/363; 362/374; 362/375

(58) Field of Classification Search ..... 362/294, 362/267, 310, 645, 158, 147, 148, 363, 362, 362/374, 375

See application file for complete search history.

(56) References Cited

U.S. PATENT DOCUMENTS

| | | | |
|---|---|---|---|
| 3,675,007 | A | 7/1972 | Appleton |
| 3,754,133 | A | 8/1973 | Youdin et al. |
| 4,094,444 | A | 6/1978 | Willis |
| 4,142,179 | A | 2/1979 | Lowndes |
| 4,156,891 | A | 5/1979 | Roche |
| 4,574,337 | A | 3/1986 | Poppenheimer |
| 4,704,665 | A | 11/1987 | Grindle |
| 5,161,881 | A | 11/1992 | Myson |
| 6,241,361 | B1 | 6/2001 | Thrasher et al. |
| 6,616,291 | B1 | 9/2003 | Love |
| 2003/0165058 | A1 | 9/2003 | Osborn, Jr. |

OTHER PUBLICATIONS

Office Action from the Chinese Patent Office dated Jun. 13, 2008, for corresponding application No. 200580030823.8, 5 pages.

*Primary Examiner* — Robert May
*Assistant Examiner* — Leah S Lovell
(74) *Attorney, Agent, or Firm* — Fish & Richardson P.C.

(57) ABSTRACT

A lighting unit includes a housing, a lamp fixture configured to be coupled to the housing, an element extending from the lamp fixture and configured to be received in the housing, and a sealing member defining an aperture for receiving the element therethrough. A periphery of the aperture forms a fluid-tight seal around the element. In another aspect, a lighting unit includes a housing and an enclosure coupled to the housing and configured to define an interior space, wherein the interior space is sealed from an interior of the housing. In another aspect, a method for sealing a lighting unit includes providing a housing, an enclosure coupled to the housing, and an opening in the housing in communication with the enclosure, placing a seal between the housing and the enclosure, and applying a sealing member to the opening to seal the opening.

20 Claims, 5 Drawing Sheets

LIGHTING UNIT DESIGNED TO MAINTAIN A T3 TEMPERATURE INSIDE ITS HOUSING

CROSS REFERENCE

This application is a continuation (and claims the benefit of priority under 35 U.S.C. §120) of U.S. patent application Ser. No. 11/940,670, filed Nov. 15, 2007, now allowed, which is a continuation of U.S. patent application Ser. No. 10/891,448, filed Jul. 15, 2004, now U.S. Pat. No. 7,300,181, which issued on Nov. 27, 2007. The prior applications are incorporated herein by reference in their entirety.

TECHNICAL FIELD

This invention relates to lighting units.

BACKGROUND

Lighting units are used in many areas including areas containing explosive gases and vapors (e.g. areas rated as Class 1, Division 2, and Zone 2 areas). A lighting unit typically includes a housing, a lamp attached to the housing, and a transparent or translucent enclosure attached to the housing and surrounding the lamp. Gases and vapors can enter the housing and enclosure through voids in exterior and interior walls of the housing. Also, heat from the lamp can migrate into the interior of the housing. Users often apply sealants to voids in the exterior walls of the housing to prevent gases and vapors from entering the housing and the enclosure.

SUMMARY

In one aspect, a lighting unit includes a housing, a lamp fixture configured to be coupled to the housing, an element extending from the lamp fixture and configured to be received in the housing, and a sealing member defining an aperture for receiving the element therethrough. A periphery of the aperture forms a fluid-tight seal around the element.

Implementations may include one or more of the following features. For example, the periphery of the aperture may form a fluid-tight seal around the element by applying pressure around the element. The sealing member may be interposed between the lamp fixture and the housing and may define a second aperture for providing a fluid-tight seal around a second element. The element may include a fastener (e.g., a screw) that attaches the lamp fixture to the housing or a wire that provides electrical energy to the lamp. A sealant, such as room-temperature vulcanized rubber ("RTV") or high-temperature vulcanized rubber ("HTV"), may be applied around the periphery of the aperture.

An enclosure may be coupled to the housing such that a periphery of the enclosure surrounds the lamp. An enclosure sealing member may be interposed between the enclosure and the housing to provide a fluid-tight seal at an interface between the enclosure and the housing. An attachment member (e.g., a clip) may be used for attaching the enclosure sealing member to the housing, and the housing may define a hole for receiving the attachment member. A sealant may be applied to an interface between the attachment member and the housing.

In another aspect, a lighting unit includes a housing and an enclosure coupled to the housing and configured to define an interior space. The interior space is sealed from an interior of the housing.

Implementations may include one or more of the following features. For example, the housing may define an opening in communication with the interior space and a sealing member, such as a gasket, may be disposed at the interface between the opening and the housing to seal the interior space from the interior of the housing. The lighting unit may include an element passing through the opening and the sealing member may be configured to seal around the element. The lighting unit may include a lamp fixture within the interior space of the enclosure and coupled to the element, and the sealing member may be disposed between the lamp fixture and the housing. The element may include a wire or a fastener, such as a screw, for attaching the lamp fixture to the housing.

The lighting unit may include an enclosure sealing member at an interface between the enclosure and the housing to seal the interior space from an external environment. The housing may define an opening, and the enclosing sealing member may be coupled to an attachment member received in the opening. A sealant, such as RTV or HTV, may be at an interface between the attachment member and the housing to seal the interior space of the enclosure from the interior of the housing. A sealant, such as RTV or HTV, also may be at an interface between the attachment member and the enclosure sealing member to seal the interior space of the enclosure from the interior of the housing.

In another aspect, a method for sealing a lighting unit includes providing a housing, an enclosure coupled to the housing, and an opening in the housing in communication with the enclosure. A seal is placed between the housing and the enclosure, and a sealing member is applied to the opening to seal the opening.

The details of one or more implementations are set forth in the accompanying drawings and the description below. Other features and advantages will be apparent from the description and drawings, and from the claims.

DETAILED DESCRIPTION

Figure 1:
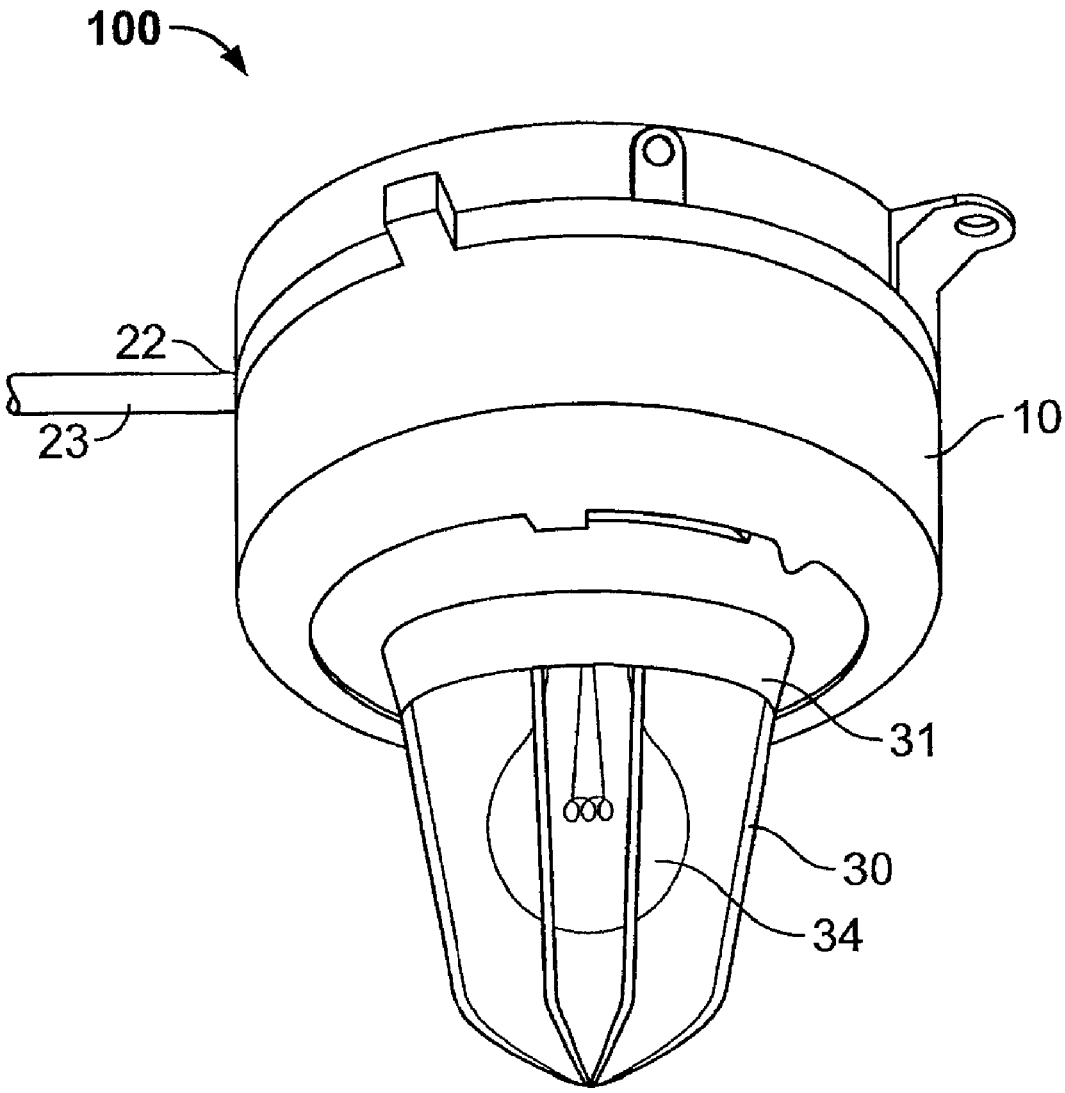
FIG. 1 is a perspective view of a lighting unit.
Figure 2A:
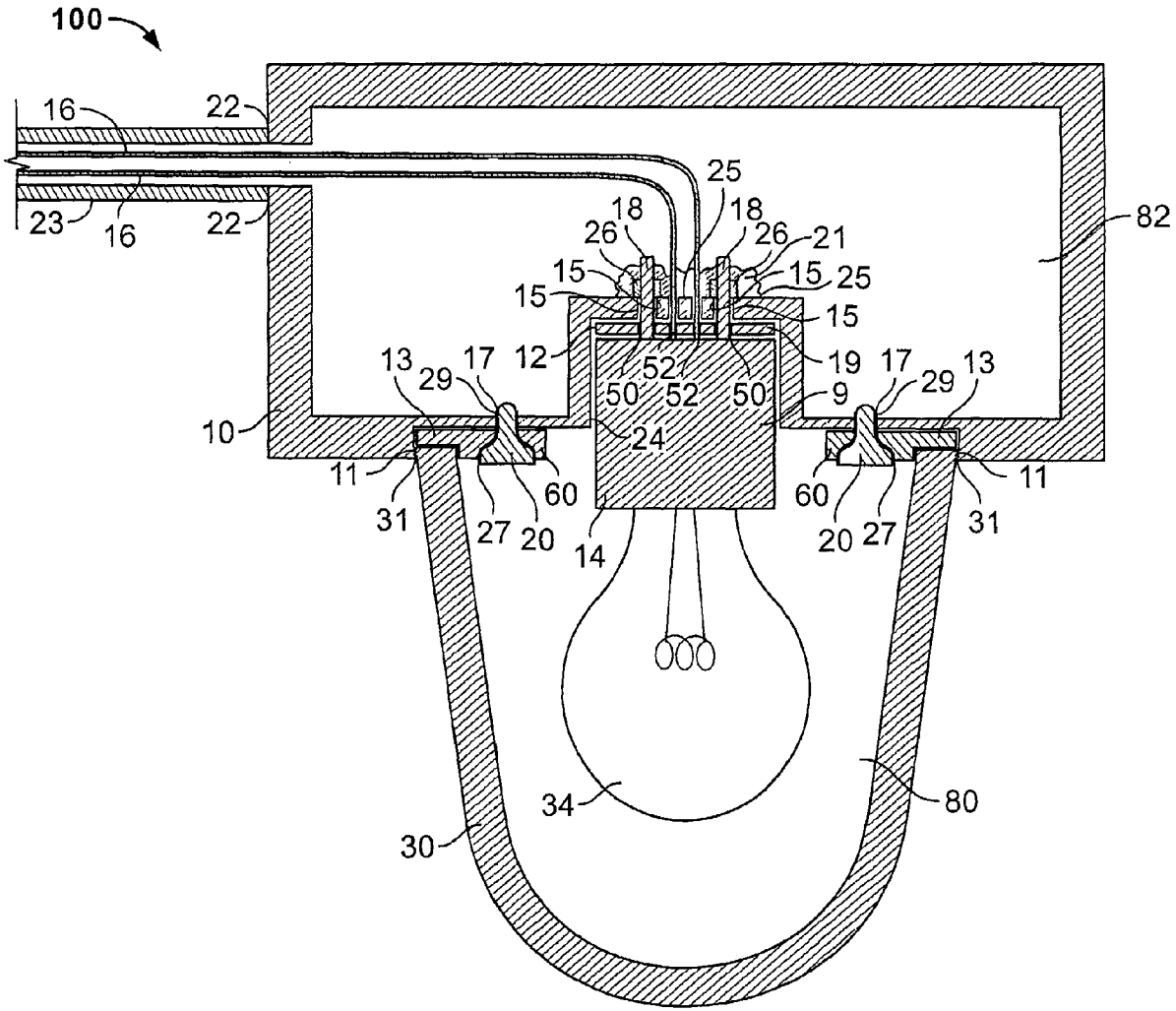
FIG. 2A is a cross sectional view of the lighting unit of FIG. 1.
Figure 2B:
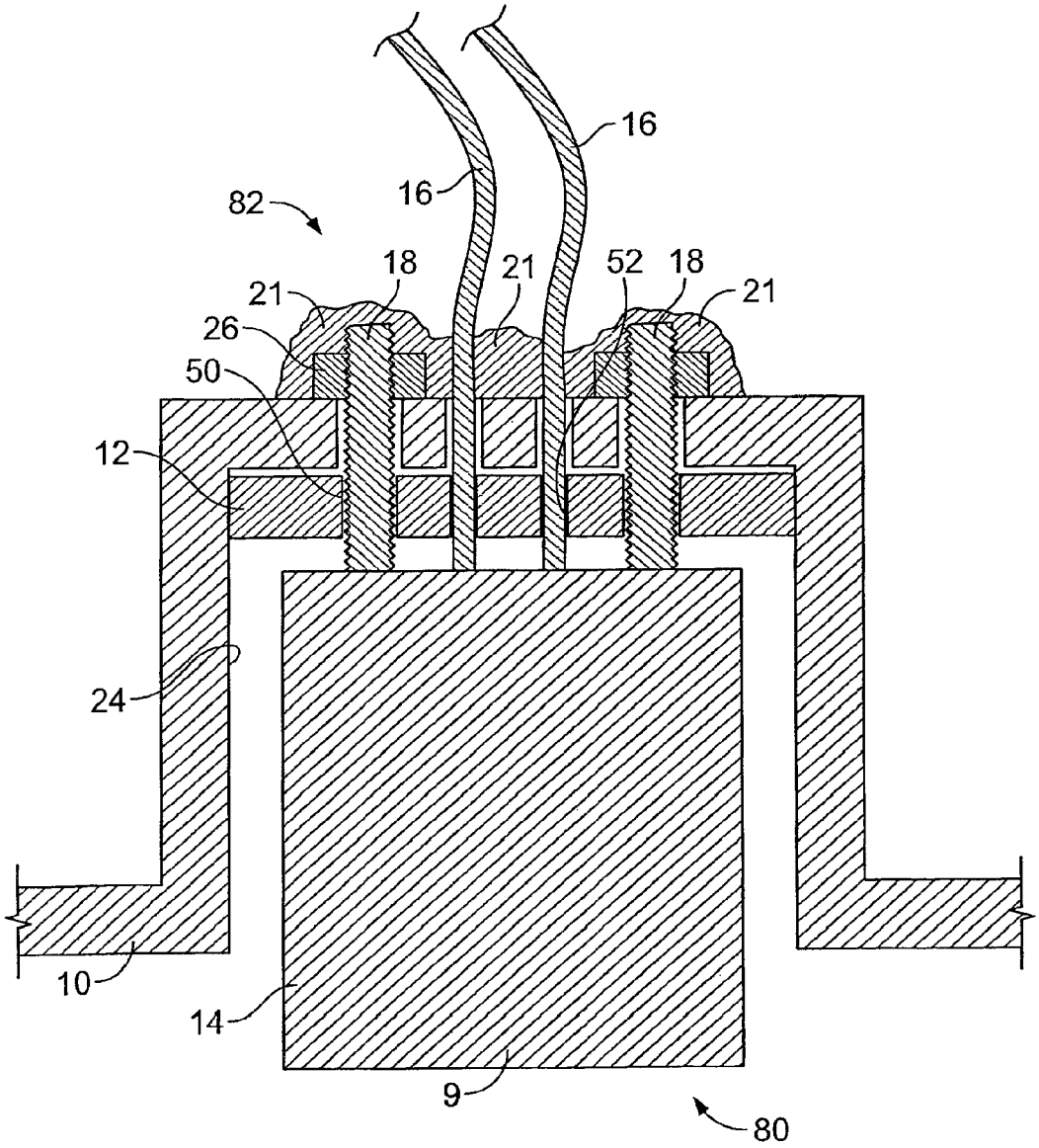
FIG. 2B is a close up of an interface between a lamp fixture and a housing of FIG. 2A.

Referring to FIGS. 1, 2A, and 2B, a lighting unit 100 includes a housing 10 and an enclosure 30 removably coupled to housing 10 by screw threads 11 to define an interior space 80. Extending from housing 10 and enclosed within enclosure 30 is a lamp 34. Lighting unit 100 also includes a conduit 23 that is coupled to housing 10 and contains wires 16 for transmitting electricity to lamp 34. Gases and vapors may potentially enter an interior 82 of housing 10 through conduit 23 and a space at a junction 22 between conduit 23 and housing 10.

Figure 3:
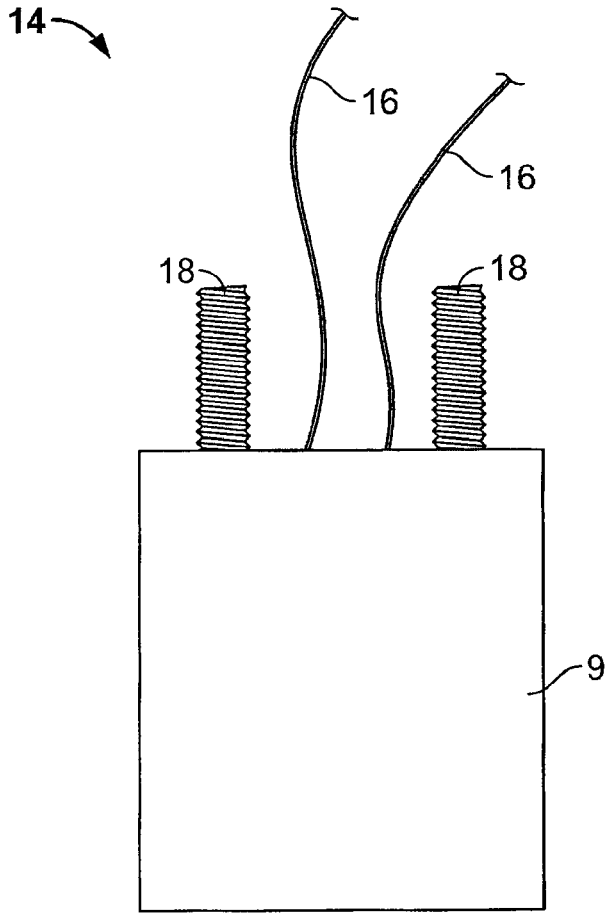
FIG. 3 is a side view of a lamp fixture of the lighting unit shown in FIG. 2.

Referring also to FIG. 3, lamp 34 is attached to housing 10 by a lamp fixture 14 that is received in a recess 24 in housing 10. Lamp fixture 14 includes a body 9, wires 16 extending from body 9 for providing electrical energy to lamp 34, and fasteners, e.g. screws 18, extending from body 9 for attaching lamp fixture 14 to housing 10. Housing 10 defines holes 15 through which wires 16 and screws 18 are received. Holes 15 provide a potential path through which gases and vapors can pass between interior space 80 of enclosure 30 and interior 82 of housing 10.

Figure 4:
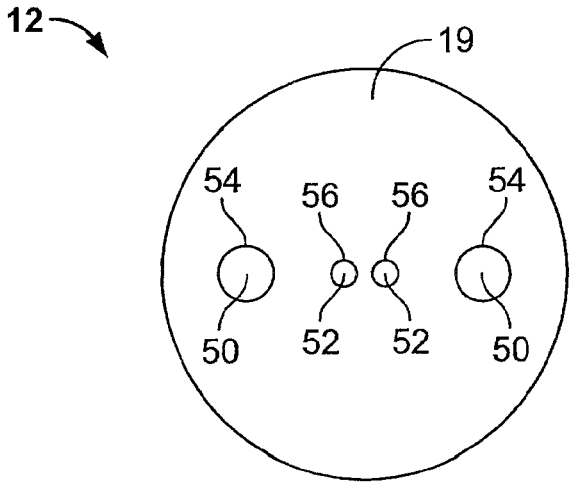
FIG. 4 is a top view of a sealing member of the lighting unit shown in FIG. 2.
Figure 5:
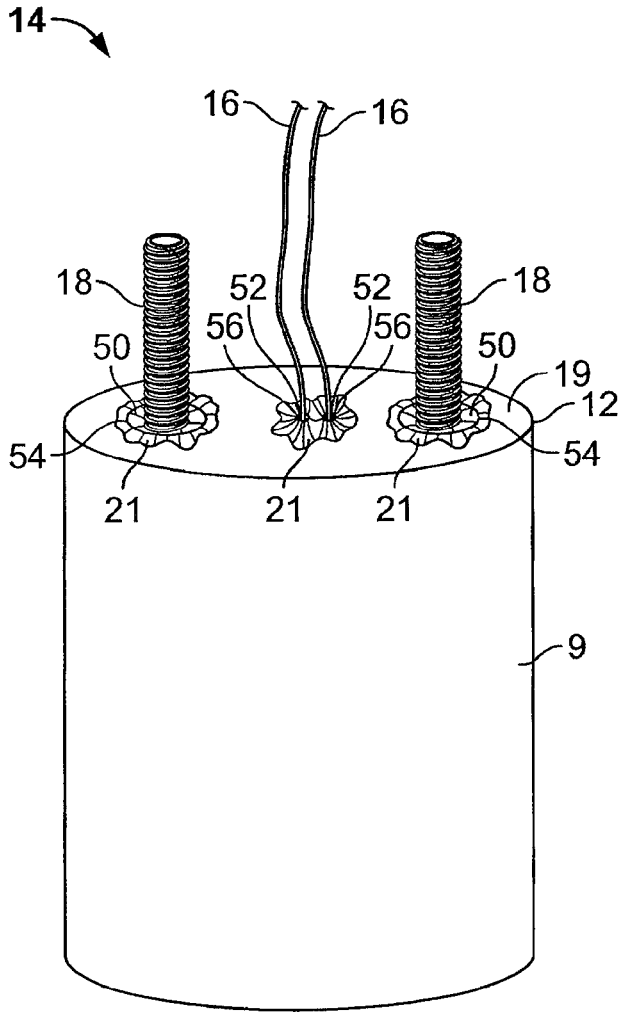
FIG. 5 is a perspective view of the lamp fixture and the sealing member.

Referring also to FIGS. 4 and 5, a sealing member in the form of a gasket 12, is disposed in recess 24 between housing 10 and lamp fixture 14 to provide a fluid-tight seal therebetween. This seal inhibits gases and vapors from entering interior spade 80 of enclosure 30 through holes 15. Gasket 12 is composed of, e.g., silicone rubber. Gasket 12 has a body 19 that defines screw apertures 50 for receiving screws 18 therethrough. Each screw aperture 50 is configured so that a periphery 54 forms a fluid-tight seal around screw 18 by applying pressure around screw 18. In addition, gasket 12 defines wire apertures 52 that receive wires 16 therethrough. Each wire aperture 52 is configured so that a periphery 56 forms a fluid-tight seal around wire 16 by applying pressure around wire 16. This pressure also serves to reduce or eliminate gas flow within wire 16 (i.e., between an outer insulator and an interior conductor of wire 16). Screw apertures 50 and wire apertures 52 can be further sealed by application of a sealant 21, such as RTV or HTV, around peripheries 54 and 56. Lamp fixture 14 is secured to housing 10 by threading nuts 26 onto screws 18. Additional sealant 25 can be applied on the interior 82 of housing 10 around wires 16 and screws 18 to further inhibit gases and vapors from entering enclosure 30.

Figure 6:
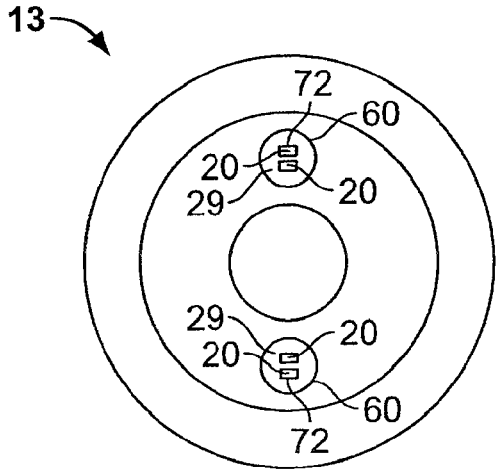
FIG. 6 is a top view of an enclosure sealing member of the lighting unit shown in FIG. 2.

Referring to FIGS. 2A, 2B, and 6, at a junction 31 between enclosure 30 and housing 10, enclosure 30 is seated against an enclosure sealing member in the form of a gasket 13 that is interposed between enclosure 30 and housing 10. Gasket 13 provides a fluid-tight seal at an interface between enclosure 30 and housing 10, which inhibits gases and vapors from entering enclosure 30 through junction 31.

Housing 10 defines holes 17 for receiving attachment members in the form of clips 20 that attach gasket 13 to housing 10. Gasket 13 defines clip apertures 60 through which clips 20 are received. Holes 17 and clip apertures 60 provide a potential path through which gases and vapors can pass between enclosure 30 and housing 10. A sealant 27, such as RTV or HTV, is applied at an interface between clip apertures 60 and an interior portion of clips 20 to inhibit gases from entering enclosure 30 through apertures 60. A sealant 29, such as RTV or HTV, is applied at an interface between an exterior portion 72 (FIG. 6) of clips 20 and holes 17 to form a fluid-tight seal to inhibit gases and vapors from entering enclosure 30 through holes 17.

Gasket 12, sealants 21, 25, 27, and 29, and enclosure sealing member 13, individually and collectively inhibit gases or vapors from entering enclosure 30 through holes 15, holes 17, and junction 31, respectively. This reduces the potential for ignition of gases or vapors by lamp fixture 14 or lamp 34. This also inhibits transfer of heat from enclosure 30 to housing 10 such that a T3 temperature rating may be provided inside housing 10. In general, to qualify for a T3 temperature rating, no exposed surface may have a surface temperature in excess of 200° C. Further, this also diminishes the need to apply sealants around conduit entries 22. For example, this eliminates any need for the installer to pour a seal in the conduit line in order to seal the area between wires and the interior walls of the conduit, as was required for prior systems to qualify for a T3 rating.

A number of implementations have been described. Nevertheless, it will be understood that various modifications may be made. For example, the gaskets can have different shapes, such as a square, a triangle, or a hexagon. The gaskets can be made of other materials, such as vulcanized elastomer compounds of natural rubber, reclaimed rubber, synthetic rubber, or rubber like materials, alone or in combination. The sealants can be composed of other types of sealants, such as flowable epoxy sealing compound, epoxy putty sealing compound and elastomeric sealing compounds. In addition, the gasket can be placed inside the housing instead of being positioned between the housing and the lamp fixture. The lamp fixture can have different numbers of wires and/or fasteners and the gasket can have corresponding numbers of apertures to receive the wires and/or fasteners. The lamp fixture can include fasteners other than screws, such as nails, clips, staples, or adhesives. The enclosure sealing member can be attached to the housing by attachment members other than clips, such as screws, nails, staples, or adhesives. The sealing members can inhibit material other than gases and vapors from entering the enclosure. These and other implementations are within the scope of the following claims.

What is claimed is:

1. A lighting unit comprising:

a housing defining an opening;

a translucent enclosure removably attached to the housing at a threaded interface to form a space within the enclosure, the opening defined by the housing forming a passage directly between a space within the housing and the space within the enclosure;

an enclosure sealing member interposed between the translucent enclosure and the housing to form a seal between the translucent enclosure and the housing;

a lamp in the space within the enclosure;

a lamp fixture accessible from the space within the enclosure, the lamp fixture configured to provide electrical energy to the lamp; and a flexible wire coupled to the lamp fixture and extending, through the passage, from the space within the enclosure to the space within the housing, the flexible wire comprising an outer insulator and an inner conductor.

2. The lighting unit of claim 1, wherein the enclosure sealing member comprises a gasket.

3. The lighting unit of claim 2, wherein the gasket is attached to the housing at the interface.

4. The lighting unit of claim 3, wherein the gasket is attached to the housing at the interface with an adhesive.

5. The lighting unit of claim 1, wherein the enclosure sealing member is attached to the housing at the interface.

6. The lighting unit of claim 1, wherein the opening defined by the housing is formed in a first side of the housing, and the housing further defines a second opening formed in a side of the housing other than the first side of the housing.

7. The lighting unit of claim 6, wherein the second opening is configured to receive a conduit.

8. The lighting unit of claim 6, further comprising a second sealing member.

9. The lighting unit of claim 8, wherein the second sealing member seals at least part of the space in the housing from a space that is exterior to the housing.

10. The lighting unit of claim 8, wherein the second sealing member is in the interior space of the housing.

11. The lighting unit of claim 10, wherein the second sealing member comprises a gasket.

12. The lighting unit of claim 11, wherein the second sealing member seals at least part of the space in the housing from a space that is exterior to the housing.

13. The lighting unit of claim 6, wherein each of the opening defined by the housing and the second opening permit access to an exterior of the housing.

14. The lighting unit of claim 1, wherein the lamp fixture is in the space within the enclosure.

15. The lighting unit of claim 1, wherein the lamp fixture is coupled to an element that is received in a recess in the housing.

16. The lighting unit of claim 1, wherein the translucent enclosure is a transparent enclosure.

17. The lighting unit of claim 1, wherein the opening defined by the housing permits access to an exterior of the housing.

18. A lighting unit comprising:

a housing defining a first opening and a second opening, the first opening formed in a first side of the housing and the second opening formed in another side of the housing;

a transparent enclosure removably attached to the housing at a threaded interface to form a space within the enclosure, wherein the first opening forms a direct passage from a space within the housing to the space within the enclosure;

a gasket attached to the housing with adhesive and interposed between the removably attached transparent enclosure and the housing to form a seal between the transparent enclosure and the housing at the interface;

a lamp in the space within the enclosure;

a lamp fixture accessible from the space within the enclosure, the lamp fixture configured to provide electrical energy to the lamp; and a flexible wire coupled to the lamp fixture and extending, through the passage, from the space within the enclosure to the space within the housing, the flexible wire comprising an outer insulator and an inner conductor.

19. A lighting unit comprising:

a housing defining an opening;

a translucent enclosure removably attached to the housing at an interface to form a space within the enclosure, the opening defined by the housing forming a passage from a space within the housing to the space within the enclosure;

a sealing member disposed in the housing that at least partially seals the space within the housing from a space external to the housing;

a lamp disposed in the space within the enclosure; and a lamp fixture accessible from the space within the enclosure, the lamp fixture configured to provide electrical energy to the lamp; and a flexible wire coupled to the lamp fixture and extending, through the passage, from the space within the enclosure to the space within the housing, the flexible wire comprising an outer insulator and an inner conductor.

20. The lighting unit of claim 19, wherein the housing defines a second opening formed in a portion of the housing other than a portion in which the opening is formed.

* * * * *